United States Patent [19]

Ridgway

[11] Patent Number: 4,704,807

[45] **Date of Patent: * Nov. 10, 1987**

[54] TRAILER FOR STORING AND DRYING HARVESTED CROPS

[76] Inventor: Steve H. Ridgway, Ridgway Farms, Rte. 1, Box 44R, Pleasanton, Tex. 78064

[ * ] Notice: The portion of the term of this patent subsequent to Aug. 12, 2003 has been disclaimed.

[21] Appl. No.: 875,634

[22] Filed: Jun. 18, 1986

Related U.S. Application Data

[63] Continuation-in-part of Ser. No. 647,747, Sep. 6, 1984, Pat. No. 4,604,815.

[51] Int. Cl.[4] ..... F26B 9/02

[52] U.S. Cl. ..... 34/201; 34/233; 98/55

[58] Field of Search ..... 34/225, 201, 202, 233, 34/168, 174; 98/54, 55, 56

[56] References Cited

U.S. PATENT DOCUMENTS

| | | | |
|---|---|---|---|
| 1,028,899 | 6/1912 | Morris | 34/170 |
| 4,604,815 | 8/1986 | Ridgway | 34/201 |

*Primary Examiner*—Larry I. Schwartz

*Attorney, Agent, or Firm*—Gunn, Lee & Jackson

[57] ABSTRACT

A trailer for storing and/or drying harvested crops, such as peanuts, which trailer is economical to build yet will store a large volume of harvested crops and will prevent mold by natural air flow therethrough. The trailer has a front truck axle with a frame for a deep narrow box being mounted thereon. The frame is enclosed on the sides with cattle panel wire and hardware cloth attached to the frame. A perforated, galvanized, corrugated tin forms a floor of the deep narrow box. An inner cage provides extra air space for drying. A gate is provided at the lower rear of the deep narrow box and a hitch at the lower front. Welded angle iron forms the frame along with diagonal braces and cross rods. Ladder steps are formed by steps attached to the angle iron.

11 Claims, 7 Drawing Figures

TRAILER FOR STORING AND DRYING HARVESTED CROPS

CROSS REFERENCE TO RELATED APPLICATION

This application is a continuation-in-part application of pending prior application Ser. No. 647,747 filed Sept. 6, 1984, now U.S. Pat. No. 4,604,815 by the same inventor for a Trailer For Storing and Drying Harvested Crops, which is incorporated herein for all purposes.

BACKGROUND OF THE INVENTION

The present invention relates to trailers for storing and drying harvested crops, such as peanuts, and, more particularly, to a trailer that will store a large volume of harvested crop and simultaneously prevent mold during drying by air flow therethrough.

Field crops, such as peanuts, are too moist at the time of harvesting to store or handle in bulk. Prior to automated farming, a method of drying harvested peanuts to put the harvested peanuts in burlap sacks and stand in the field for drying by the ambient conditions therearound. However, drying the peanuts in burlap sacks has many drawbacks, especially when there is high humidity, which may include periods of rain. The drying of the peanuts in burlap sacks required the frequent moving of the sacks, which results in a large amount of labor.

In U.S. Pat. Nos. 4,238,890 and 4,222,317 by Curtis, a trailer is shown that has a wire mesh therearound along with conical air directors for directing air into conduits inside of the trailer. The trailer as shown in Curtis is used for field drying of the peanuts as long as air may be directed inside of the trailer into relatively close proximity with all of the peanuts stored therein. However, the conical air directors and conduits cause the trailer to be very expensive and take away from the storage space of the trailer. Also a single wire mesh that is very expensive is used on all sides and the bottom of the trailer. However, the trailer as shown in Curtis has limited volume, is expensive to build, and is not structurally sound.

In the drying of harvested crops, such as peanuts, if a wire mesh trailer is used for drying of the harvested crops by the air flow therethrough, through, one has to be careful to prevent aflogilis mold, which gives off an aflatoxin. If an aflogilis mold forms on peanuts, then regulations of the Food and Drug Administration prevent any of the peanuts in the entire trailer from being used as an edible food product. See paragraphs 181–190 of the *Farmers' Stock Peanuts—Inspection Instructions* published by the United States Department of Agriculture (revised July 1985). Therefore, it is extremely important to prevent a mold build-up during the drying process. Since direct sunlight would have a tendency to cause the mold build-up, a cover, such as shown in Curtis, is typically used to prevent direct impingement by the sunlight on the top of the peanuts being dried. Section 51.12 of the "Regulations Governing Inspection, Certification, and Standards for Fresh Fruits, Vegetables and Other Products" also requires that the produce be made reasonably accessible for sampling and inspection.

SUMMARY OF THE INVENTION

It is an object of the present invention to provide a trailer for storing and drying harvested crops, such as peanuts, which trailer is economical to build, yet will store and dry a large volume of harvested crops.

It is a further object of the present invention to provide a trailer for drying harvested crops, such as peanuts, by natural air flow therethrough without the formation of an aflogilis mold.

It is still another object of the present invention to provide a trailer that has a deep narrow box mounted on a front truck axle so that all peanuts contained therein will be within 15–24 inches of air outside the trailer.

It is yet another object of the present invention to provide a trailer having a frame mounted on a front truck axle, which frame is enclosed on the sides with cattle panel wire to hold the peanuts in the trailer. The hardware cloth, which is relatively inexpensive, does not have sufficient strength to hold the peanuts in the trailer without the backing of the substantially stronger cattle panel wire.

The present invention shows a direct hitch two-wheel trailer mounted on a front truck axle. The front truck axle allows a deep narrow box to be mounted thereon with the box being as close to the ground as possible. The frame for the deep narrow box is welded directly onto the front truck axle between the two tires. Angle iron is used to form the frame, which angle iron is welded together forming the long deep narrow box. Cross bracing is also provided for the angle iron. As a floor for the long deep narrow box, perforated galvanized corrugated tin is mounted on the angle iron. The perforations allow water and sand to exit out through the bottom of the trailer and still let air in.

On the sides to the trailer inside of the frame is mounted the cattle panel wire, which is secured to the frame by welding or other suitable means. Over the cattle panel wire inside of the trailer, hardware cloth is mounted, the hardware cloth being of a size to prevent peanuts from falling out of the trailer. The hardware cloth and cattle panel wire allow the air to freely impinge against any peanuts that may be contained in the trailer. An inner cage runs longitudinally along the trailer to provide an interior air space for maximum drying.

Over the top of the trailer is a cover that may be rolled up when not in use or spread over the trailer when the trailer is loaded with peanuts.

On the sides of the trailer are mounted ladder steps to allow an individual to climb to the top of the tailer to inspect or spread the peanuts. At the lower end of the trailer is a gate, which may be opened to unload the peanuts at a storage facility. The gate is releasably secured in position by a pin.

Below the front direct hitch of the trailer is a rectangular mount which holds the front end of the trailer up a short distance off the ground.

In the present invention, depending upon the climate of the area in which the trailer is to be used, the width of the trailer may vary between 30–48 inches in width. A typical width would be approximately 38 inches. By the use of the front truck axle, the box depth is approximately 10 feet, 4 inches, with the lower part of the box being approximately 16 inches off of the ground. This provides a relatively low center of gravity with the resultant trailer being one that can be moved over most highways without violation of laws or regulations. The approximate length of the trailer is 20 feet, 4 inches. It should be realized that the box depth and length may vary, keeping in mind the objective to build as economical a trailer as possible that will store as large a volume of peanuts for natural air drying, while at the same time preventing aflogilis mold.

Immediately after harvesting, the moisture content of the peanuts would normally be between 22–24%. Until the moisture level of the peanuts has been reduced to 20%, it may be necessary to periodically shuffle the peanuts inside of the trailer by unloading and reloading the peanuts at the storage facility. When the moisture content of the peanuts are reduced to below 20%, they may be left in the trailer without shuffling for drying below a 10.5% moisture content. After peanuts are dried below 10.5% moisture content, the peanuts may then be stored in bulk at the terminal without further danger of aflogilis mold. During dry, windy weather conditions, it may never be necessary to shuffle the peanuts; however, during wet weather conditions, it may be necessary to shuffle the peanuts even below 20% moisture.

FIG. *6a* is a partial rear perspective view with the gate closed.

FIG. *6b* is a partial rear perspective view with the gate opened.

DESCRIPTION OF THE PREFERRED EMBODIMENT

Figure 1:
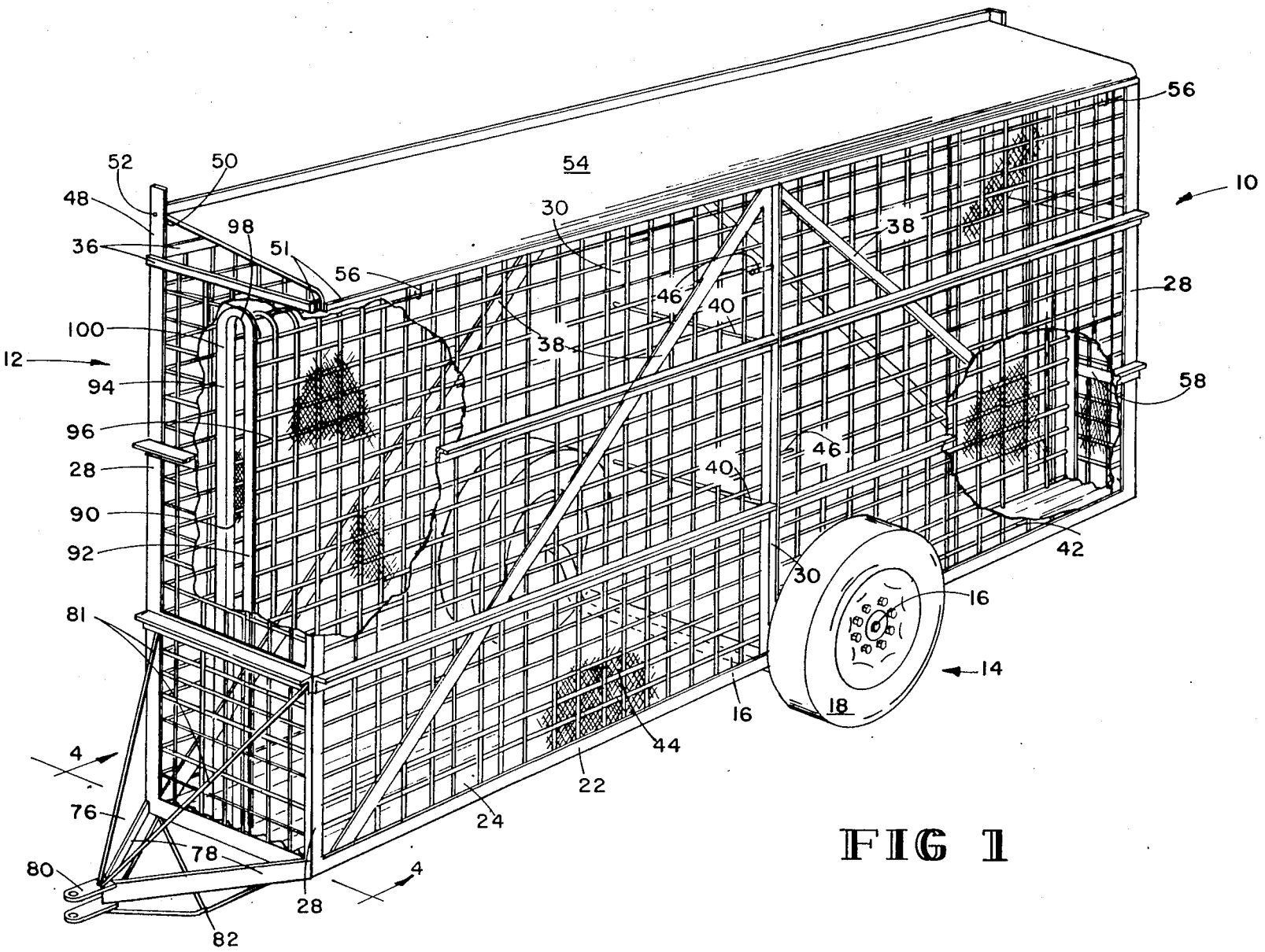
FIG. 1 is a perspective view of the present invention.
Figure 4:
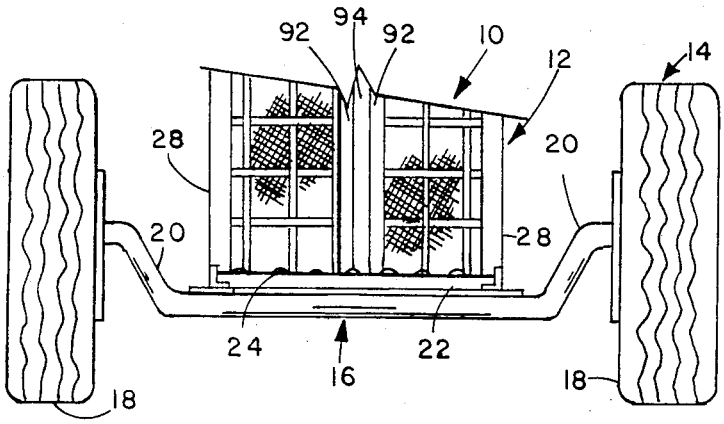
FIG. 4 is a partial front view of FIG. 1 along section lines 4—4.

Referring now to FIG. 1, there is shown a drying trailer for a harvested crop, such as peanuts. Hereinbelow for the ease of reference, the trailer will simply be referred to as a "peanut drying trailer"; however, it should be realized that other harvested crops could likewise be stored and dried in the trailer. The peanut drying trailer represented generally by reference numeral 10 includes a long narrow box 12 mounted on a single set of wheels 14. So that the box can have the maximum possible height and still be transported over roads without violation of the law, the single set of wheels 14 are connected together by a front truck axle 16. Typically front truck axles may be rated for 7,000, 9,000 or 12,000 pounds. Tires 18 are typically 10×20 truck tires. The front truck axle 16 has a downward curve 20 (which can be more fully seen in FIG. 4) that allows the box 12 to sit as close to the ground as possible.

Mounted on the truck axle 16 is a frame for the box 10, which frame is formed from angle iron. Lower angle iron 22 is connected to the front truck axle 16 by any convenient means, such as welding. The axle 16 should be placed slightly behind the center point of lower angle iron 22 to insure a continual downward force on the front of trailer 10. The lower angle iron 22 would typically be 3″×3″×5/16″ angle iron.

Resting on the inside angle of the lower angle iron 22 is the bed 24. The bed 24 should contain apertures large enough to allow sand to flow therethrough, but not the peanuts, and to allow air ventilation therethrough. Also the bed should be smooth enough to allow the peanuts to easily flow to the back of the trailer 10 when the front end is raised, which is the typical method used for unloading at most storage facilities.

Figure 3:
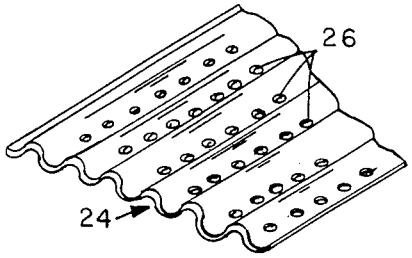
FIG. 3 is an enlarged view of the floor of the trailer shown in FIG. 1.

In the present invention, the bed 24 may be formed from a galvanized, corrugated tin sheet having a typical thickness of 29 gauge. One such tin is sold under the brand name of HiCore. The material being used for the bed can be more clearly seen in FIG. 3. The valleys in the corrugated tin forming the bed 24 are perforated with a series of holes 26 that are approximately ¼-inch in diameter and spaced no more than 3 inches apart. The holes 26 may be formed a row at a time by simultaneously punching each of the holes 26. The holes 26 allow sand and water out of the bottom of the trailer 10, while letting air in. Also galvanized corrugated tin forming bed 24 is smooth enough to allow the peanuts to slide out of the rear of the trailer if the front end is raised.

Extending upward from each of the corners of the lower angle iron 22 are corner posts 28 and from the middle center posts 30. The corner posts 28 and center posts 30 are also formed from angle iron with a typical size angle iron being 2″×3″×¼″.

Extending between the corner posts 28 and/or center posts 30 is first level angle iron 32, second level angle iron 34, and third level angle iron 36. The first, second and third level angle irons 32, 34 and 36 are connected to the corner posts 28 and/or center posts 30 by any convenient means, such as welding, with the resultant skeleton frame forming a box having relatively smooth inside walls.

Diagonal bracing is provided for the frame of the box 12 by diagonal iron strips 38, which extend from the lower ends of corner posts 28 to the upper ends of center posts 30. To provide additional strength to the box 12 in the middle thereof to prevent it from buckling outward under heavy loads, center rods 40 connect between the center posts 30.

Figure 2:
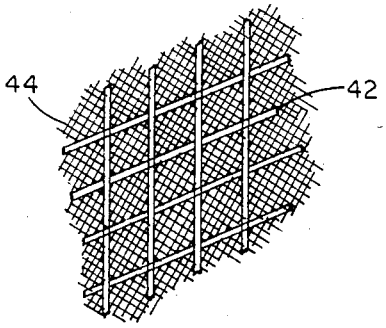
FIG. 2 is an enlarged view of the side panels of the trailer shown in FIG. 1.

After completion of the frame of the box 12 so that it has a relatively smooth inside surface, cattle panel wire 42 is connected inside of the frame. The cattle panel wire 42 can be more clearly seen in FIG. 2, which is an enlarged section of a portion of one side of the trailer 10. The cattle panel wire 42 is attached to the frame by any convenient means, such as welding. The cattle panel wire may typically by 6″×6″, number 4 gauge, galvanized cattle panel wire as made by Oklahoma Wire & Steel. Cattle panel wire typically comes in 5′×20′ sections.

Connected over the cattle panel wire 42 inside of the trailer 10 is hardware cloth 44. The hardware cloth 44 may be attached by any convenient means, such as hog rings. A typical hardware cloth that can be used is a galvanized 2×2 (four squares per square inch) manufactured by Keystone Steel & Wire in Peoria, Ill. by use of hardware cloth over cattle panel wire, an economical wire mesh that has sufficient strength to hold crops, such as peanuts, is formed. The angle iron forming the posts 28 and 30 along with connecting angle iron 32, 34 and 36 and diagonal iron strips 38 provide a good sturdily constructed peanut drying trailer 10.

An inner longitudinal air space 94 may be provided by means of an inner cage 100. Inner cage 100 is formed of end mountings 90 and 92 which support additional cattle panel wire 42 and hardware cloth 44. The hardware cloth 44 is extended over the top of inner cage 100 to insure that no peanuts or other debris will fall therein, thus providing further aeration of trailer 10. Inner cage 100 completely extends from the front of trailer 10 to the rear.

To allow access to the inside of the trailer 10 when loaded, steps 46 are connected to the center posts 30 by any convenient means, such as welding. By stepping on axle 16, then tires 18, first and second level angle iron 32 and 34, and the steps 46, an individual can easily climb to the top of the trailer 10.

On one side of the trailer 10, the corner posts 28 have extensions 48 that extend up a short distance of approximately 12 inches. This can be more clearly seen when viewing FIG. 5 in conjunction with FIG. 1. One side of the angle iron forming corner posts 28 is cut off (not shown in FIG. 5) so that a cover 54 may be mounted by screws 52 at the uppermost portion of the extension 48. Located on extension 48 is the cover 54 that may be stretched over the peanut drying trailer 10 as illustrated in FIG. 1 when the trailer is full of peanuts. This configuration is also illustrated in broken lines in FIG. 5. The cover 54 may be of any suitable material, but the cover utilized by applicant is an 18-oz. vinyl coated nylon sold under the mark CoverLight by Reeves Manufacturing. The cover 54 is flexible enough to be rolled up or folded. To allow for ease of use on a farm, the cover 54 is attached on each side between two thick strips of wood nailed together to form fixed anchor 50 and movable anchor 51. The cover 54 may be rolled up around the movable anchor 51. Hooks 56 are connected on the ends of the cover 54 for hooking onto the cattle panel wire 42 to hold the cover 54 over the peanuts.

Figure 6A:
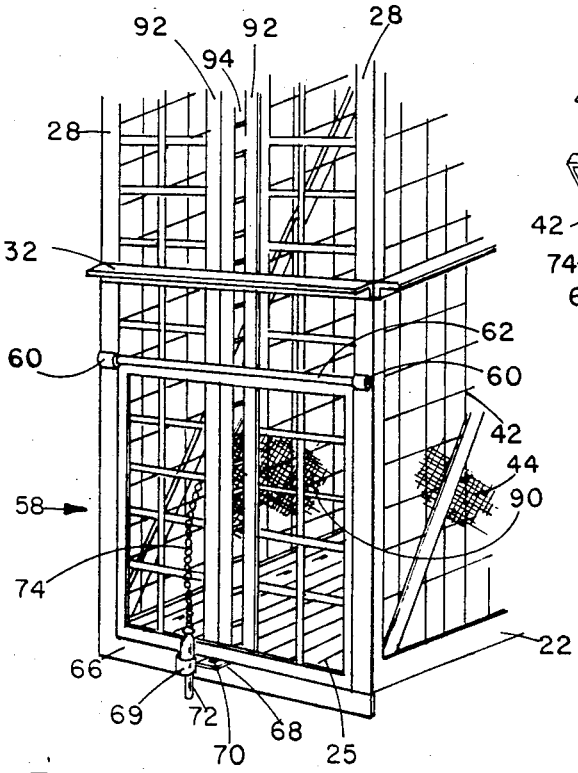
Figure 6B:
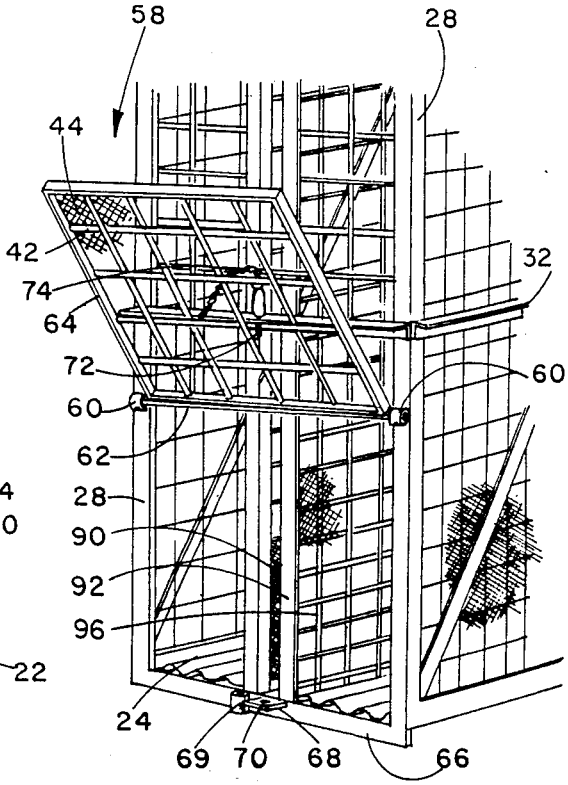

Referring now to FIGS. 6*a* and 6*b* in conjunction with FIG. 1, a rear gate 58 is illustrated. The rear gate 58, which is the closed position in FIG. 6*a* and the opened position in FIG. 6*b*, is pivotally connected about pipe 62 located inside of hinges 60. The hinges 60 are welded to corner posts 28 and the pipe 62 pivoting therein is welded to rear gate 58. The rear gate 58 has a gate frame 64 therearound on which is again attached cattle panel wire 42 and hardware cloth 44 as previously described for the sides. The gate frame 64 abuts against corner posts 28 and rear angle iron 66. Extending outward from rear angle iron 66 is hitch 68. A hole 70 in the center of hitch 68 allows for a connection of a second trailer to the rear of trailer 10. Adjacent to the hitch is a short pipe 69 for receiving pin 72 therein for holding the rear gate 58 closed. The pin 72 may be mounted on chain 74 for convenience and to keep the pin 72 from dropping into an unloading pit or being lost.

Referring back to FIG. 1, a direct hitch 76 is provided for the trailer 10. Angle iron 78 extends inward to form a triangle with the lower front corners of the trailer 10. A tractor hitch 80 is provided at the front thereof. Extending downward from the trailer hitch 76 is an inverted tripod 82 on which the front of the trailer may rest when it is not connected to a vehicle, such as a tractor. For additional strength, braces 81 connect between tractor hitch 80 and angle iron 32 as shown.

Figure 5:
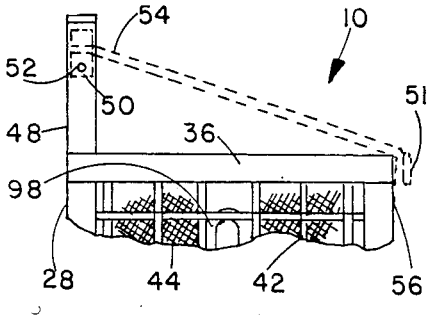
FIG. 5 is an upper front view of FIG. 1 with a cover shown spread over the trailer in broken lines.

The peanut drying trailer 10 may either be used in the field to load the peanuts thereon when harvested and/or transported to the drying station, or it may be used at the drying station alone. When the peanut drying trailer 10 is fully loaded and is being used to dry the peanuts, the trailer should be set so that the wind will strike the broad side of the trailer 10. The cover 54 should be extended over the trailer as shown in FIGS. 1 and 5 to prevent direct sunlight from striking the peanuts. During the first 36 hours of drying, the greatest danger of aflogilis mold exists. Therefore, during the first two or three days, it may be necessary to periodically shuffle peanuts in the trailer at the storage facility. This can easily be done by attaching a tractor to the trailer hitch 80 and moving the trailer 10 to the loading/unloading bay. By lifting the front of the trailer 10, and removing the pin 72 for the gate frame 64, the peanuts are unloaded through the rear of the trailer 10 and subsequently reloaded on the trailer 10. Once the peanuts drop below 20% moisture, except when there is very high humidity and/or rain, the peanuts can be left in the trailer 10 until they drop below the 10.5% moisture necessary for bulk storage. Thereafter the peanuts can be unloaded at the storage facility and/or sold.

The peanut drying trailer 10 as described hereinabove is very economical to build. Almost any farm shop that has welding facilities could build the peanut drying trailer. The peanut drying trailer is designed so that two sections of cattle panel wire 42 can be used on each side without the necessity of cutting. By use of cattle panel wire 42, an economical wire mesh, such as hardware cloth 44, may be used in forming the sides. Diagonal iron strips 38 and center rods 40 provide additional strength to insure the trailer 10 is rugged.

By use of front truck axle 16, the trailer 10 is very low to the ground thereby increasing the depth thereof.

By having a trailer 10 that is between 30–48 inches wide, all peanuts being dried inside of the trailer 10 will be within 15–24 inches of ambient air. Narrower trailers 10 should be used in areas having greater rainfall and wider trailers 10 in dryer areas.

By construction of a trailer 10 as described hereinabove, it has a maximum simplicity, strength and volume, while at the same time being very economical to construct.

I claim:

1. A trailer for storing and/or drying harvested crops, such as peanuts, comprising:

at least one front truck axle having tires on each end thereof;

a frame attached to a lower portion of said front truck axle, said frame being formed to give a long narrow deep rectangular box with smooth inner walls;

cattle panel wire attached to said smooth inner walls;

hardware cloth overlapping said cattle panel wire and attached thereto, said hardware cloth having sufficient strength to hold said crops inside said trailer and a small enough mesh to prevent said crops from spilling therethrough from said trailer, said cattle panel wire being of sufficient strength to support said hardware cloth;

at least two corner posts on one side of said frame extending above said trailer for supporting a cover thereon, said cover being extendable over said trailer;

hitch means attached at a lower front of said trailer;

gate means releasably secured at a lower rear of said trailer, said gate means also being covered with said cattle panel wire and said hardware cloth;

floor means with holes therein for allowing moisture and sand out and air in;

an inner longitudinal cage providing air space; and width of said trailer being between 30" and 48".

2. The trailer for storing and/or drying harvested crops as recited in claim 1 wherein said frame further includes posts at each corner and additional posts therebetween, at least one level of horizontal support extending between said corner posts and said additional posts approximately parallel with said bed means.

3. The trailer for storing and/or drying harvested crops as recited in claim 2 wherein said frame further includes a rim around a top of said trailer connected between said corner posts and said additional posts, said corner posts, additional posts and horizontal support being made from angle iron.

4. The trailer for storing and/or drying harvested crops as recited in claim 3 wherein said cattle panel wire has squares approximately 6" by 6" and is approximately 4 gauge, and said hardware cloth has approximately 4 squares per square inch.

5. The trailer for storing and/or drying harvested crops as recited in claim 1, 2, 3 or 4 further comprising a hitch connected to a lower front of said frame, said hitch having an inverted tripod therebelow to support said trailer thereon.

6. The trailer for storing and/or drying harvested crops as recited in claim 2 further including steps attached to said additional posts to aid climbing to top of said trailer.

7. The trailer for storing and/or drying harvested crops as recited in claims 1, 2, 3 or 4 wherein said cover is flexible and water resistant and supported above said harvested crops, said cover being held in position over said harvested crops by hooks on one side thereon for releasable attachment to said cattle panel wire.

8. The trailer for storing and/or drying harvested crops as recited in claim 5 wherein said trailer is approximately 38" wide, 20'4" long and 10'4" high.

9. The trailer for storing and/or drying harvested crops as recited in claim 1, 2, 3 or 4 wherein said bed means is formed from galvanized, corrugated tin.

10. The trailer for storing and/or drying harvested crops as recited in claim 9 wherein said tin is approximately 29 gauge and has approximately ¼" perforations in valleys thereof approximately 3" apart.

11. The trailer for storing and/or drying harvested crops as recited in claim 1, 2, 3 or 4 wherein said inner longitudinal cage is comprised of:

two pairs of end mountings, one pair each located at either end of said trailer;

additional cattle panel wire supported by said end mountings, running from the front of said trailer to the rear of said trailer; and additional hardware cloth overlapping and attached to said additional cattle panel wire, said additional hardware cloth extending over the top of said inner longitudinal cage to prevent debris from falling therein.

* * * * *